United States Patent [19]

Elfström

[11] 4,056,906

[45] Nov. 8, 1977

[54] BUILDING FRAMEWORK FOR TIMBER HOUSE OF LOG-CABIN APPEARANCE

[75] Inventor: Carry Allon Elfström, Landskrona, Sweden

[73] Assignee: Arca Holding S.A., Luxembourg, Luxembourg

[21] Appl. No.: 714,278

[22] Filed: Aug. 13, 1976

[30] Foreign Application Priority Data

Aug. 14, 1975 Sweden ..... 75090993

[51] Int. Cl.[2] ..... E04B 1/10

[52] U.S. Cl. ..... 52/233; 52/747

[58] Field of Search ..... 52/233, 311, 275, 747

[56] References Cited

U.S. PATENT DOCUMENTS

| | | | |
|---|---|---|---|
| 2,690,072 | 9/1954 | Reed | 52/275 X |
| 3,189,950 | 6/1965 | Johnson | 52/233 |
| 3,377,758 | 4/1968 | Witschnig | 52/233 |

FOREIGN PATENT DOCUMENTS

| | | | |
|---|---|---|---|
| 213,847 | 11/1966 | Sweden | 52/233 |

*Primary Examiner*—Ernest R. Purser
*Assistant Examiner*—Carl D. Friedman
*Attorney, Agent, or Firm*—Karl F. Ross

[57] ABSTRACT

A building constructed in log-cabin style has outer walls formed from superposed wooden boards which, on adjacent walls meeting at a corner joint, are relatively offset by half the height of a board. Each board terminates at the joint in a tongue of reduced height and thickness lying flat against a side of a reduced neck of an associated junction block, also of wood, whose enlarged head partly overlies the tongues of two boards of the orthogonally adjoining wall. The tongues and associated blocks may be positively interlinked by mating ribs and grooves, a dove-tail fit or other surface formations; they could also be held together by nails and/or glue. Aligned pairs of boards of the same wall can be held together by similar blocks offset from them by half their height.

16 Claims, 10 Drawing Figures

FIG. 2
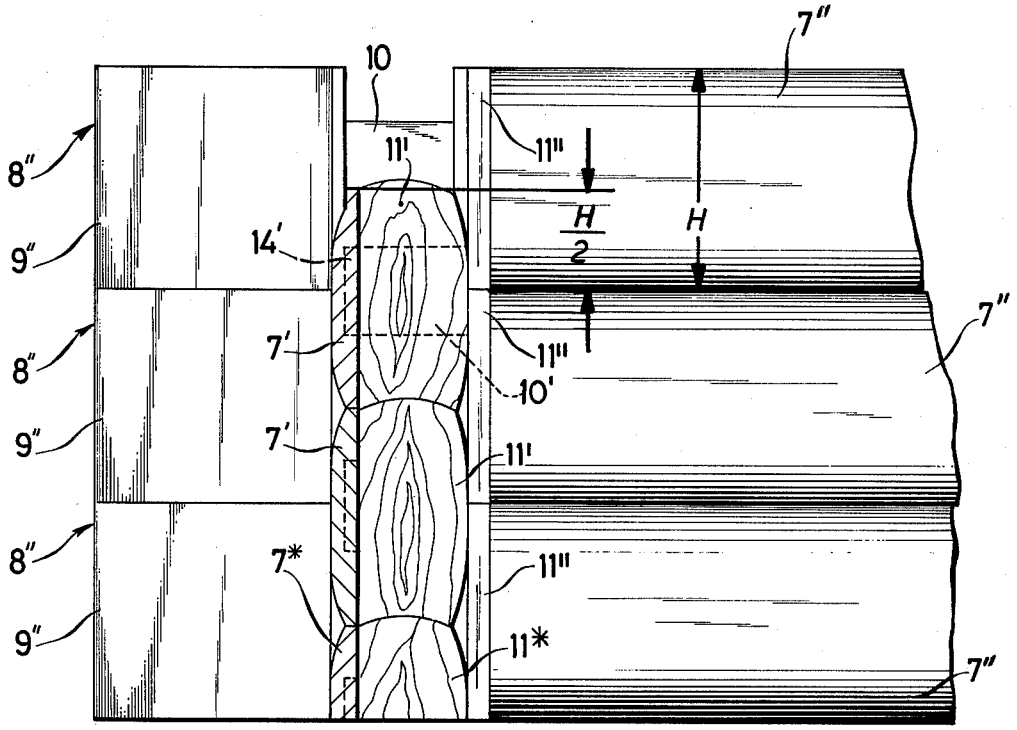
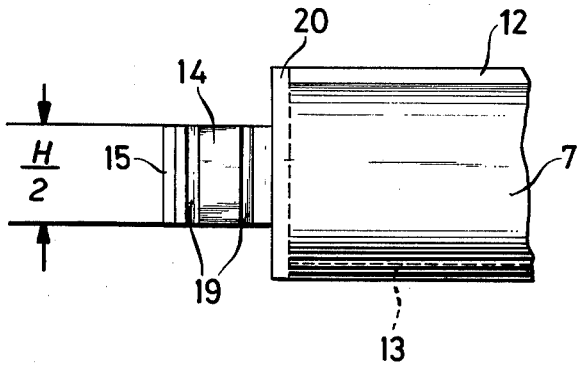
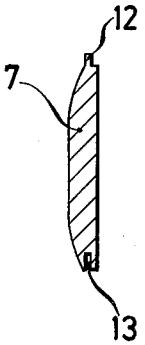
FIG. 4
FIG. 5

FIG. 9
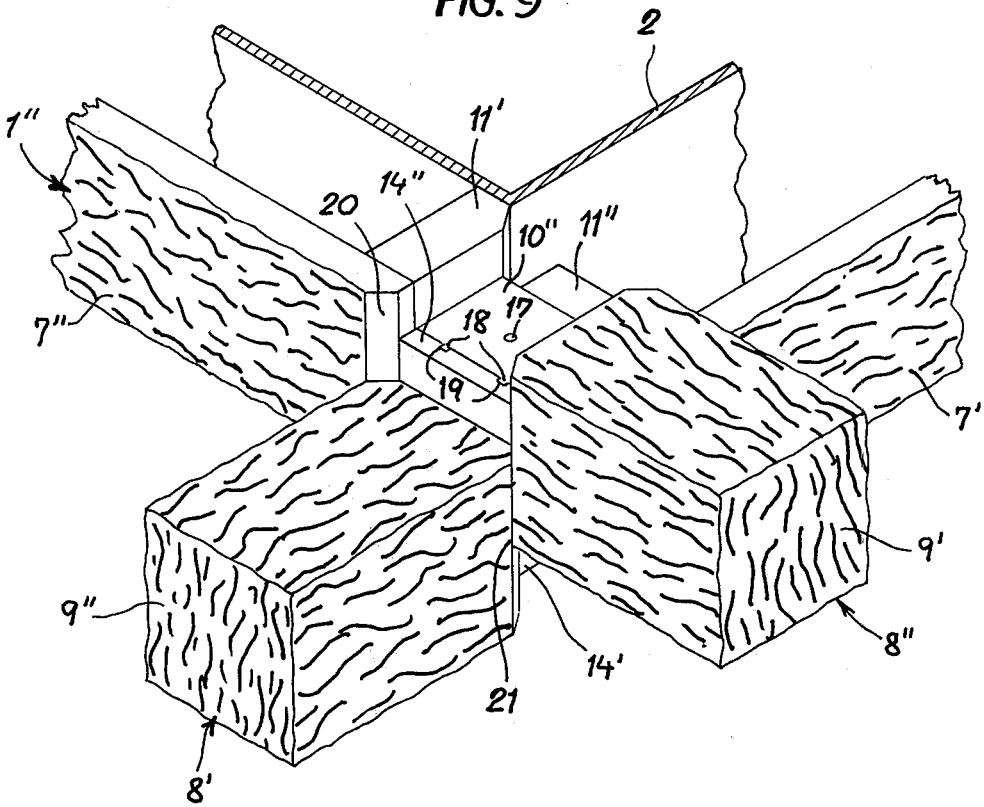
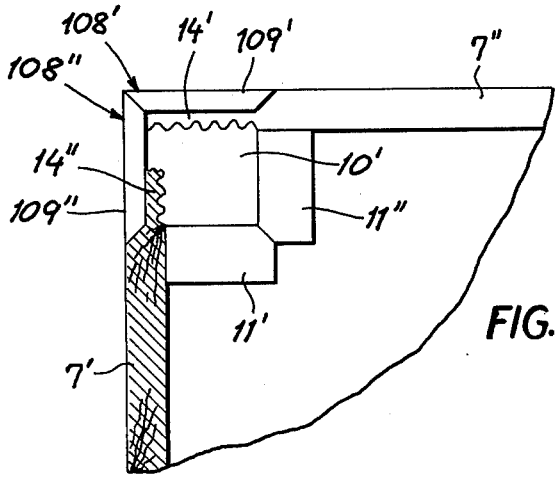
FIG. 8

BUILDING FRAMEWORK FOR TIMBER HOUSE OF LOG-CABIN APPEARANCE

FIELD OF THE INVENTION

My present invention relates to a building framework, more particularly to a wall structure therefor, and to a method of erecting such a structure.

BACKGROUND OF THE INVENTION

There has lately been an increasing demand for houses or cabins built from logs, especially as vacation homes. In contrast to the conventional modular homes, which are built from prefabricated units, buildings of log-cabin style constructed from rough timbers must be assembled by hand and are therefore relatively costly to erect. When constructed from unseasoned wood, they tend to develop structural defects as the timbers shrink during drying and gaps are formed between them.

Various proposals already exist for the construction, from prefabricatd parts, of houses having the appearance of log cabins, with corner joints formed from stacked blocks whose log-shaped heads project beyond the outer surfaces of the adjoining walls. Such a construction is shown, for example, in German Pat. No. 186,837, with the boards of an outer wall section coming to rest against the rear faces of the block heads. According to Swiss Pat. No. 433,675 the blocks have rearward extensions to which the boards of the inner section of a double wall are secured. All these prior structures have imperfections from both a mechanical and an esthetic viewpoint.

OBJECTS OF THE INVENTION

The principal object of my present invention, therefore, is to provide an improved framework for a building of the type discussed above which obviates the disadvantages of the prior art.

A related object is to provide a method of efficiently erecting such a building on site from prefabricated elements.

It is also an object of my invention to utilize the same techinique in the erection of smooth-surfaced residential or utility buildings.

SUMMARY OF THE INVENTION

In accordance with my present invention, two mutually orthogonal walls meeting at a corner of a building framework comprise sets of first and secnd coplanar, superposed boards of uniform height forming the outer wall surfaces, the boards of one wall being vertically offset by half their height from those of the other wall. Two sets of junction blocks, aligned with respective boards of the two walls so as to face in mutually perpendicular directions, have projecting heads of about the height of the boards and reduced necks of not more than half that height, the blocks being stacked by their necks whereby the latter form a corner column. Each board has a tongue projecting towards the head of an associated block aligned with it and resting against a side of the neck of that block; the tongue is held in position by the heads of adjoning blocks, on the next-upper and next-lower levels, lying at right angles to the board concerned. Thus, the heads of the blocks of one set form clearances with the necks of the blocks of the other set into which the tongues of the boards associated with the last-mentioned blocks are inserted to form a corner joint. This joint can be mechanically strengthened in various ways, especially by an interfitting of mating surface formations on the tongues and the adjoining neck faces. The boards and the associated junction blocks can also be preassembled before being transported to the building site, as by a nailing or gluing of their tongues to the neck faces. In that case the introduction of the tongues into the clearances formed between the necks and the heads of differently oriented blocks occurs concurrently with the stacking of the blocks.

In an all-wood construction in which the boards and the junction blocks are cut from similarly seasoned lumber, drying of the wood may result in a slight and substantially uniform settling of the entire framework with no significant relative displacement of the interfitted elements.

Although my invention is primarily intended to satisfy the demand for economic buildings of log-cabin type with the heads of the junction blocks extending beyond the outer wall surfaces, its principles are also applicable to frameworks wherein the heads of the blocks project only far enough beyond the inwardly recessed tongues to lie flush with the outer surfaces of the adjoining boards.

BRIEF DESCRIPTION OF THE DRAWING

The above and other features of my invention will now be described in detail with reference to the accompanying drawing in which:

FIG. 2 is a cross-sectional view taken along the line II — II of FIG. 1;

FIG. 4 is a cross-sectional view of a board forming part of the framework;

FIG. 5 is a fragmentary view of such a board;

FIGS. 7 and 8 are views similar to FIG. 6, showing other modifications;

FIG. 9 is an isometric view of part of the corner joint shown in FIG. 1.

SPECIFIC DESCRIPTION

Figure 1:
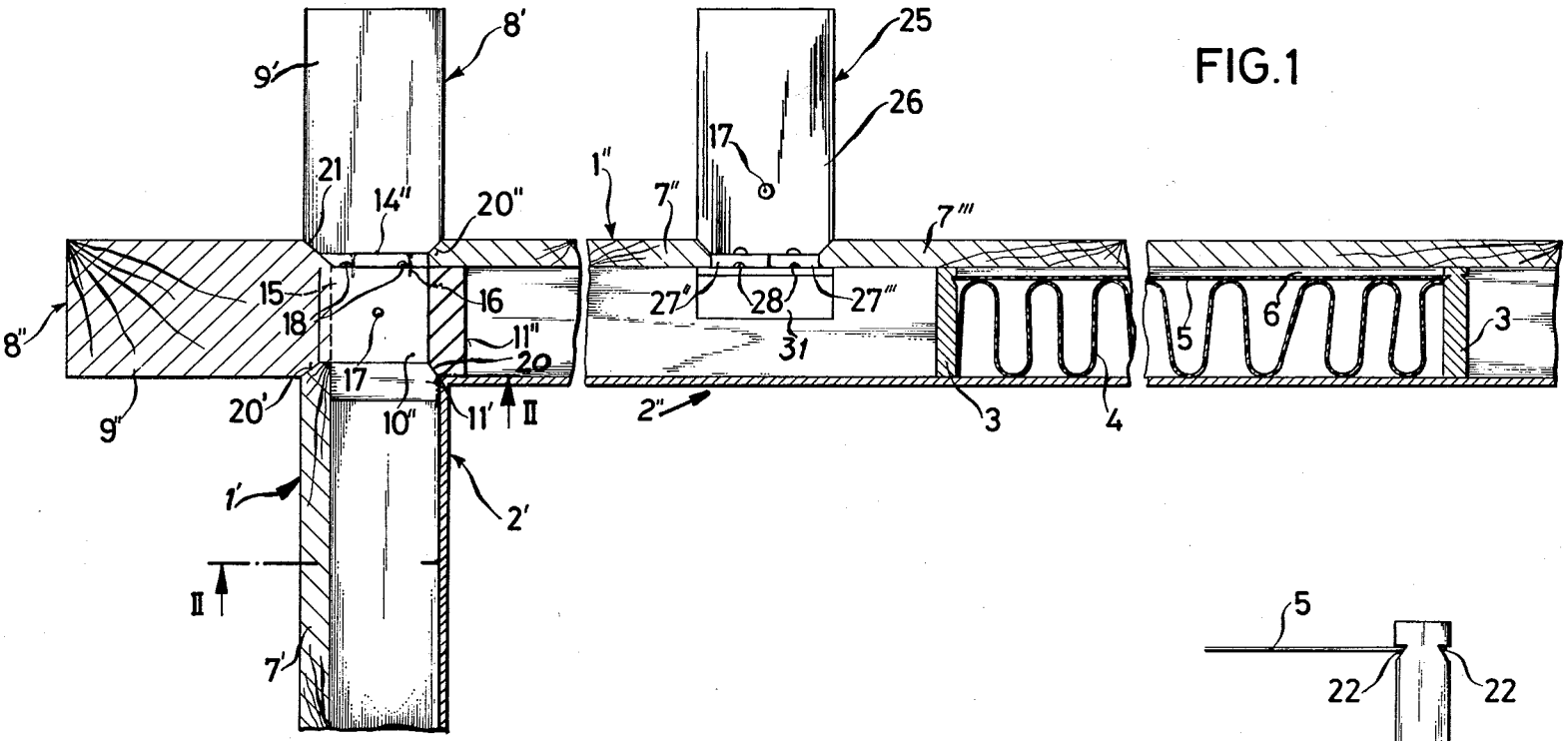
FIG. 1 is a sectional plan view of a representative portion of a building framework according to my invention, showing a corner joint between two mutually orthogonal walls.

In FIG. 1 I have shown part of a building framework which includes two orthogonally adjoining walls 1' and 1'' meeting at a corner. Each wall has an outer section and an inner section separated from each other by an air space, the outer wall section being composed of superposed boards 7', 7'' of rough-hewn wood as best seen in FIG. 2. The boards 7' of wall 1' and 7'' of wall 1'' are relatively offset by half the board height H. The lowest board of wall 1', designated 7*, is therefore only half as high as the others. Wall 1' may also have a similar half-size board at the top in order to terminate at the same level as wall 1''.

Figure 3:
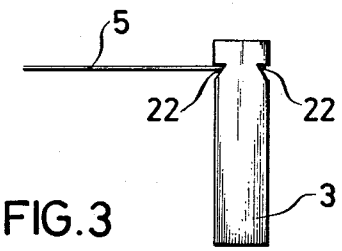
FIG. 3 is a detail view relating to the construction of one of the walls meeting at the joint of FIG. 1.

The inner sections of walls 1' and 1'' are formed by sheets 2', 2'' of any suitable material such as, for example, plaster of paris. As particularly illustrated for wall 1'', the two wall sections are interconnected by transverse stiffening ribs 3 and their intervening space can be occupied, in whole or in part, by thermal insulation 4 consisting for example of rock wool, glass fibers or synthetic resin foamed in situ. Weatherproofing partitions 5 (only one shown) may extend next to the outer wall sections formed by boards 7' and 7'', being separated therefrom by air spaces 6. These partitions, e.g., of plastic or sheet metal, may be snapped from within into triangularly profiled vertical grooves 22 of ribs 3 as best shown in FIG. 3.

In accordance with my present invention, each board 7', 7'' is aligned with a respective junction block 8', 8'' whose forwardly projecting head 9', 9'', of the same height H as the board, has a face flush with the outer surface of the corresponding wall. Blocks 8' and 8'' have necks 10' and 10'' (see also FIGS. 6 – 9) of height H/2, these necks 10' and 10'' being alternately superposed to form a column at the corner joint defined by walls 1' and 1''. (The necks and heads could also have a height lower than H/2 and H, respectively, if shims or pads were inserted therebetween.) In the embodiment shown in FIGS. 1 and 2 the blocks 8' and 8'' terminate in rear extensions or feet 11' and 11'' adjoining their necks 10' and 10'', these extensions having the same height H as the boards 7', 7'' and the heads 9', 9''. Feet 11' and 11'' project laterally inwardly beyond the respective necks 10', 10'' but are flush with these necks along their outer faces which are in line with the inner surfaces of boards 7' and 7'', respectively; these inner board surfaces are flat, in contrast to the outer board surfaces which may be convex as shown in FIG. 4.

As best illustrated in FIG. 5 for a generic board 7, each board is formed with a tongue 14 of the same height as the necks of the junction blocks, i.e. H/2. The tongues 14 shown in FIG. 5 have beveled ends 15 by which they come to rest against similarly beveled flanks 21 of the associated block heads as illustrated in FIG. 1 for a tongue 14'' and the head 9'' of the corresponding block 8''. These flanks 21 also form contact surfaces between the relatively staggered heads 9' and 9'' of the mutually perpendicular blocks 8' and 8''. In a similar manner, feet 11' and 11'' contact one another along beveled flanks 20. Such bevel joints are also formed at 20' between boards 7' and heads 9'' as well as at 20'' between boards 7'' and heads 9'.

The tongues 14' and 14'' of boards 7' and 7'', disposed at different levels, are alo reduced in thickness with reference to their boards so as to fit into clearances formed between the necks of the associated blocks and the heads of the nonassociated blocks, i.e., between necks 10'' and heads 9' in the case of tongues 14'' (FIG. 1) and between necks 10' and heads 9'' in the case of tongues 14' (FIG. 2). As shown in FIGS. 1, 5 and 9, the tongues have vertical grooves 19 matingly receiving ribs 18 on the adjoining neck faces whereby the boards and the blocks are mechanically interlocked against relative twisting or longitudinal shifting. FIGS. 4 and 5 further show the boards provided with tenons 12 and mortises 13 by which they are conventionally interfitted to form a wall section.

The block extensions 11' and 11'' may be complementarily curved along their adjoining edges as illustrated for extensions 11' in FIG. 2. This Figure also shows that the bottom block of that set, represented by its foot **11*, must be halved in the same manner as the associated board 7*. Both the front and rear ends of each junction block preferably have a rough-hewn appearance as illustrated in FIGS. 2 and 9.**

A positive connection between each tongue and the adjoining neck can be established, either during erection of the building framework or upon preassembly at the factory, by fasteners such as nails 16 (FIG. 1). Associated tongues and necks could also be glued to each other. The column of superposed alternating necks 10', 10'' can further be traversed by a vertical stiffening rod 17 received in aligned bores of these necks. Thus, a mechanically stable and fluidtight corner joint is formed at the junction of walls 1' and 1''.

Figure 10:
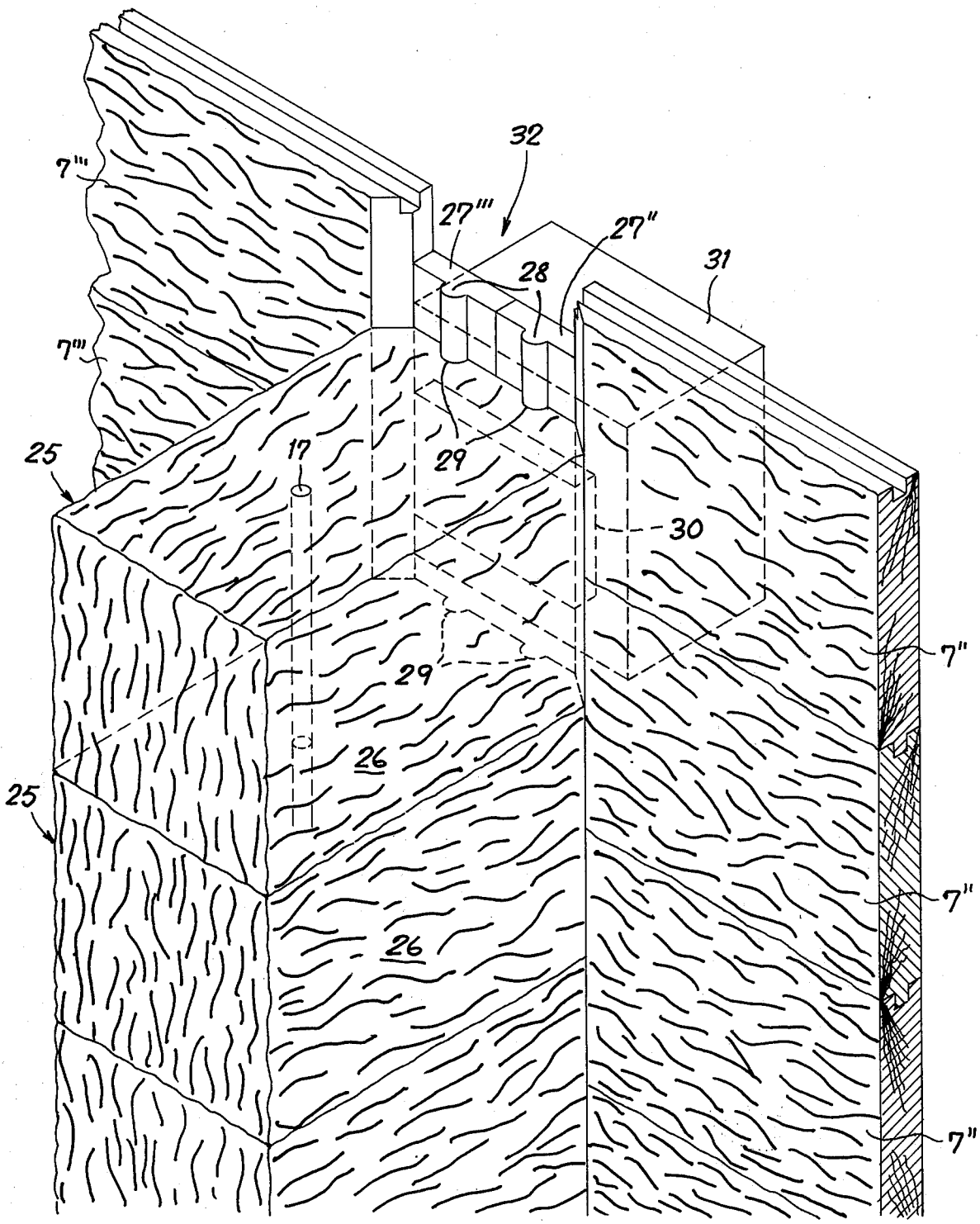
FIG. 10 is an isometric view of part of the framework of FIG. 1, showing a stack of intermediate blocks.

If the boards are shorter than the wall sections to be formed therefrom, they will have to be extended by additional boards 7''' aligned therewith as particularly illustrated in FIGS. 1 and 10 for the boards 7'' of wall 1''. These boards have tongues 27'' and 27''', similar to tongues 14' and 14'', which meet in a vertical plane bisecting a stack of intermediate blocks 25 having heads 26, necks 30 and rear extensions or feet 31. The necks 30 fit into square apertures 32 framed by the tongues 27'', 27''' of a lower and an upper pair of boards 7'', 7'''. The tongues 27'', 27''' and the heads 26 are formed with mating ribs 28 and grooves 29 designed to stabilize their connection. Another reinforcing rod 17 is shown driven through the stack of blocks 25.

These intermediate blocks 25 also have a decorative character by being made of rough-hewn wood to enhance the log-cabin aspect of the buildling. They could be positioned, for example, above or below door and window openings defined by foreshortened boards of the sets 7'', 7'''.

Figure 6:
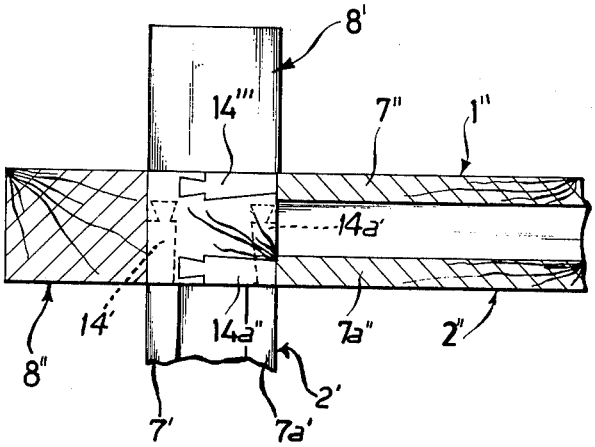
FIG. 6 is a sectional plan view showing a modification of the corner joint of FIG. 1.

As illustrated in FIG. 6, the inner wall sections 2' and 2'' may likewise be formed by boards *7a', 7a''* paralleling the boards 7' and 7'', the inner boards *7a'* and *7a''* being preferably of the same rough-hewn appearance (as seen from within the building) as the outer boards so as to carry the log-cabin character also to the interior. Tongues *14a'* and *14a''* of boards *7a'* and *7a''* lie against inner faces of the necks of the associated blocks 8' and 8'' with which they are here shown interlocked by a dovetail fit. The inner tongues *14a'* and *14a''* intersect each other and thereby further stabilize the joint. The spaces between the outer and inner boards may be occupied by thermal insulation as schematically indicated at 4 in FIG. 1.

Figure 7:
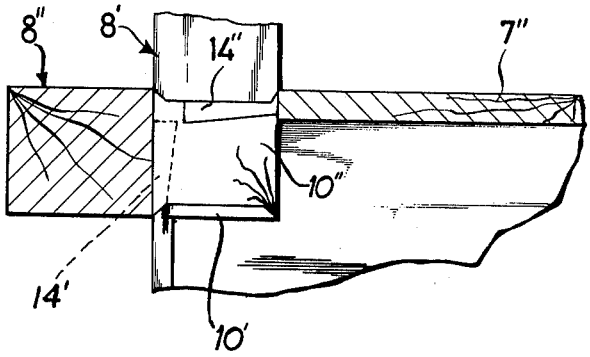

In FIG. 7 I have shown wedge-shaped tongues 14' and 14'' matingly engaging the rearwardly diverging necks of blocks 8' and 8''. A serration-type fit between the necks and the tongues has been illustrated in FIG. 8. Naturally, these various kinds of interfitting formations could be interchangeably used with walls made from one or two sections of superposed boards. The rearward divergence of the necks in the assemblies of FIGS. 6 and 7 eliminates the need for enlarged rear extensions or feet 11' and 11''.

The tongues could have a height less than H/2, e.g., down to about H/4. In that instance, however, the clearances left between the heads and the necks of adjacent blocks will not be fully occupied by these tongues and may have to be filled with suitable packing material.

As further illustrated in FIG. 8, the heads of the junction blocks may be foreshortened so as to provide a smooth rather than a knotty wall surface. Thus, modified junction blocks 108' and 108'' have heads 109' and 109'' whose front faces are flush with the outer surfaces of boards 7'' and 7', respectively. Blocks 108' and 108'' are otherwise similar to the blocks 8' and 8'' shown in FIGS. 1 and 2. Again, their rear feet 11' and 11'' could be omitted particularly if their necks diverge rearwardly as shown for necks 10′ and 10″ in FIGS. 6 and 7.

In erecting a structure according to my invention, one first starts with juxtaposing a full-size board 7″ and a half-size board 7* with associated junction blocks on the ground and then builds up the framework in successive steps by superposing additional boards and blocks thereon. A half-block like the one shown at 11* in FIG. 2 will be placed on top in order to complete the column. The roof can now be mounted on the framework after which all the internal partitioning, flooring, installation of plumbing and wiring, interior decorating etc. can be carried out under shelter.

Conventional log cabins built to the usual dimensions from 6-inches (15 cm) timbers require an amount of wood approximately 14 $m^3$ in volume. A comparable cabin built in accordance with my present invention requires only about 3.6 $m^3$ of wood. There is also a gain in useful surface area which increases from, say, 50 $m^2$ by about 3 $m^2$. Thus, the cost of such a building will be on the same order of magnitude as that of conventional modular houses of comparable capacity.

The basic elements of the disclosed framework, namely the blocks and the boards, can be readily transported to the building site in the trunk and on the roof, respectively, of a normal passenger car. Only small quantities of sealants or impregnants are required in view of the reduced amount of wood.

Naturally, these construction elements could also be manufactured from other materials such as synthetic resins.

I claim:

1. A building framework comprising:

two mutually orthogonal walls meeting at a corner, one of said walls comprising a set of coplanar superposed first boards forming a first outer wall surface, the other of said walls comprising a set of coplanar superposed second boards forming a second outer wall surface, all said first and second boards being of the same height, said second boards being vertically offset by half said height from said first boards; and first and second junction blocks with projecting heads substantially as high as said boards and with reduced necks not more than half as high as said boards, said first and second junction blocks being alternately superposed by their necks at said corner on the levels of said first and second boards, respectively, said first boards having tongues disposed alongside the necks of said first junction blocks and held in position by the heads of said second junction blocks, said second boards having tongues disposed alongside the necks of said second junction blocks and held in position by the heads of said first junction blocks, said tongues being narrower than said boards and recessed from said outer wall surfaces, said heads and said boards adjoining one another along beveled flanks.

2. A building framework as defined in claim 1 wherein said boards and junction blocks consist of rough-hewn wood.

3. A building framework as defined in claim 1 wherein the heads of said first and second junction blocks project beyond said second and first outer wall surfaces, respectively.

4. A building framework as defined in claim 1 wherein said tongues and said necks are provided with interlocking surface formations.

5. A building framework as defined in claim 1 wherein said tongues are fixedly secured to the adjacent necks.

6. A building framework as defined in claim 1 wherein the superposed necks of all said junction blocks are provided with aligned vertical bores traversed by a throughgoing rod.

7. A building framework as defined in claim 1 wherein said junction blocks are provided with inward extensions substantially as high as said boards and laterally enlarged on the sides opposite said tongues, said extensions of said first and second junction blocks adjoining one another along beveled flanks.

8. A building framework as defined in claim 1 wherein said one of said walls further comprises a set of coplanar superposed third boards inwardly spaced from said first boards and provided with tongues disposd alongside the necks of said first junction blocks opposite the tongues of said first boards, said other of said walls further comprising a set of coplanar superposed fourth boards inwardly spaced from said second boards and provided with tongues alongside the necks of said second junction blocks opposite the tongues of said second boards in interlocking relationship with the tongues of said third boards.

9. A building framework as defined in claim 1 wherein said one of said walls has a pair of additional boards aligned with a pair of said first boards at a location remote from said corner, said pairs of first and additional boards having adjoining ends provided with tongues of reduced height framing a four-sided aperture, further comprising an intermediate block at said location having a neck received in said aperture, a head overlying said framing tongues on said first outer wall surface and an inward extension overlying said framing tongues from within.

10. A building framework comprising:

two mutually orthogonal walls meeting at a corner, one of said walls comprising a set of coplanar superposed first boards forming a first outer wall surface, the other of said walls comprising a set of coplanar superposed second boards forming a second outer wall surface, all said first and second boards being of the same height, said second boards being vertically offset by half said height from said first boards; and first and second junction blocks with projecting heads substantially as high as said boards and with reduced necks not more than half as high as said boards, said first and second junction blocks being alternately superposed by their necks at said corner on the levels of said first and second boards, respectively, said first boards having tongues disposed alongside the necks of said first junction blocks and held in position by the heads of said second junction blocks, said second boards having tongues disposed alongside the necks of said second junction blocks and held in position by the heads of said first junction blocks, said junction blocks being provided with inward extensions substantially as high as said boards and laterally enlarged on the sides opposite said tongues, said extensions of said first and second junction blocks adjoining one another along beveled flanks.

11. A building framework as defined in claim 10 wherein said boards and junction blocks consist of rough-hewn wood.

12. A building framework as defined in claim 10 wherein the heads of said first and second junction blocks project beyond said second and first outer wall surfaces, respectively.

13. A building framework comprising:

two mutually orthogonal walls meeting at a corner, one of said walls comprising a set of coplanar superposed first boards forming a first outer wall surface, the other of said walls comprising a set of coplanar superposed second boards forming a second outer wall surface, all said first and second boards being of the same height, said second boards being vertically offset by half said height from said first boards;

first and second junction blocks with projecting heads substantially as high as said boards and with reduced necks not more than half as high as said boards, said first and second junction blocks being alternately superposed by their necks at said corner on the levels of said first and second boards, respectively, said first boards having tongues disposed alongside the necks of said first junction blocks and held in position by the heads of said second junction blocks, said second boards having tongues disposed alongside the necks of said second junction blocks and held in position by the heads of said first junction blocks, said one of said walls having a pair of additional boards aligned with a pair of said first boards at a location remote from said corner, said pairs of first and additional boards having adjoining ends provided with tongues of reduced height framing a four-sided aperture; and an intermediate block at said location having a neck received in said aperture, a head overlying said framing tongues on said first outer wall surface and an inward extension overlying said framing tongues from within.

14. A building framework as defined in claim 13 wherein said boards, said junction block and said intermediate block consist of rough hewn wood.

15. A building framework as defined in claim 13 wherein said tongues are narrower than said boards and recessed from said outer wall surfaces, said heads and said boards adjoining one another along beveled flanks.

16. A method of erecting a building framework with two mutually orthogonal walls meeting at a corner, comprising the steps of:

preassembling a set of boards with respective junction blocks each having a projecting head of substantially the height of said boards and a reduced neck of substantially half said height, each board having a tongue not higher than said neck coming to rest against the neck of the respective junction block;

forming a stack of said junction blocks with the latter alternately facing in mutually perpendicular directions, with superposition of the necks of said junction blocks in a column and with formation of a vertical clearance between the head of each junction block and the necks of the perpendicularly facing adjoining blocks, said clearance accommodating the tongue of the board respectively preassembled with each junction block; and interfitting the boards preassembled with said perpendicularly facing junction blocks in coplanar superposed relationship to form said mutually orthogonal walls.

* * * * *